United States Patent [19]

Rieker et al.

[11] Patent Number: 4,611,742

[45] Date of Patent: Sep. 16, 1986

[54] ELECTROMAGNETICALLY OPERATED DRIVING TOOL WITH AIR DAMPER

[75] Inventors: Werner Rieker, Waldenbuch; Fritz Schädlich, Leinfelden-Echterdingen, both of Fed. Rep. of Germany

[73] Assignee: Robert Bosch GmbH, Stuttgart, Fed. Rep. of Germany

[21] Appl. No.: 783,757

[22] Filed: Oct. 3, 1985

[30] Foreign Application Priority Data

Oct. 9, 1984 [DE] Fed. Rep. of Germany ..... 3437019

[51] Int. Cl.[4] ..... B25C 1/00; B25C 5/02; B25C 5/06; B25C 5/15

[52] U.S. Cl. ..... 227/131; 173/121; 173/139; 227/130; 227/134

[58] Field of Search ..... 173/119, 120, 121, 162, 173/139; 227/120, 130, 131, 134

[56] References Cited

U.S. PATENT DOCUMENTS

| | | | |
|---|---|---|---|
| 1,853,695 | 4/1932 | Mortimer | 173/119 X |
| 3,345,546 | 10/1967 | Beltramo | 227/131 X |
| 3,434,026 | 3/1969 | Doyle | 227/131 X |
| 4,183,453 | 1/1980 | Barrett et al. | 227/131 |
| 4,230,249 | 10/1980 | Nasiatka et al. | 227/123 |
| 4,290,489 | 9/1981 | Leavell | 173/17 |
| 4,441,644 | 4/1984 | Farian | 173/139 X |
| 4,515,303 | 5/1985 | Schädlich et al. | 227/131 |

FOREIGN PATENT DOCUMENTS

| | | | |
|---|---|---|---|
| 1039001 | 9/1978 | Canada | 227/131 |
| 0054782 | 4/1981 | European Pat. Off. . | |

*Primary Examiner*—Paul A. Bell
*Attorney, Agent, or Firm*—Michael J. Striker

[57] ABSTRACT

In an electromagnetically operated driving tool, in which a cup-shaped plunger carrying a driver blade is axially slidable in a solenoid, an air damper, combined with a check valve, is provided to damp the plunger during its backward movement to an inoperative position. A hollow cylinder positioned in the plunger is vented through an opening in a housing of the tool and has an interior which is closed at its end with a liftable valve flap. A throttle gap is formed between the plunger and the cylinder, which is adjustable by a piston movable in the cylinder which is made of elastic plastics and is elastically expandable to vary the throttle gap.

7 Claims, 7 Drawing Figures

ELECTROMAGNETICALLY OPERATED DRIVING TOOL WITH AIR DAMPER

BACKGROUND OF THE INVENTION

The present invention relates to an electromagnetically powered driving tool in general, and more particularly to a driving tool provided with an air damper.

Electromagnetically powered driving tools of the type under discussion are known. One of the driving tools of the type under consideration is disclosed in U.S. Pat. No. 4,183,453 and also in U.S. Pat. No. 4,515,303. The electromagnetically operated driving tool of the known construction includes a solenoid, a plunger which slides axially of the solenoid, a driver blade for driving fasteners, connected to the plunger, and a magazine for holding a plurality of fasteners and for advancing the fasteners in position for driving engagement with the driver blade.

The return movement of the plunger of such a driving tool is affected by various factors. The adjusted strength of the stroke, the length and the type of the fastener and the material of a workpiece are very important.

In order to obtain an optimal return (the fastest, click-free return movement) of the plunger for all operational conditions the return damping must be adjustable. The afore-mentioned German patent application discloses means for such an adjustment.

SUMMARY OF THE INVENTION

It is an object of the present invention to provide an improved electromagnetically powered driving tool.

It is another object of this invention to provide an easily and precisely adjustable device for an air damper of the driving tool.

These and other objects of the invention are attained by an electromagnetically operated driving tool, comprising a solenoid; a cup-shaped plunger axially slidable within said solenoid; a hollow member axially extended in said plunger and forming therewith an air damper; a check valve cooperating with said hollow member; a return spring acting on said plunger, said hollow member and said plunger forming therebetween a throttle gap; a driver blade connected to said plunger to move therewith, wherein a return stroke of said driver blade is affected by said air damper; and a piston received in said hollow member, said piston causing an elastic expansion of said hollow member whereby said throttle gap formed between an outer surface of said hollow member and an inner surface of said plunger is changed.

The hollow member may be a cylinder having an interior formed with a conical portion at a free end thereof, said piston being displaceable in the region of said conical portion.

Due to the provision of the conical portion on the inner surface of the hollow cylinder the air gap between the outer surface of the hollow cylinder and the inner surface of the cup-shaped plunger can be precisely varied. Since the air gap serves as a throttle gap for the air damper the damping action is also well adjustable.

The piston may have at least one opening for passing air therethrough.

The piston may carry said check valve, said check valve being a valve flap. This arrangement is particularly advantageous. The check valve may include an insert axially movable in the interior fo said hollow member and a valve flap at an end of said insert.

The driving tool may further include a housing, an adjustment rod extended in said hollow member, said piston being axially non-movably connected to said rod, said rod having a handle positioned outside said housing and a threaded portion extended through a threaded bore formed said housing.

The hollow member may be made of an elastic plastics and have a thin wall to provide said elastic expansion.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENTS

Figure 1:
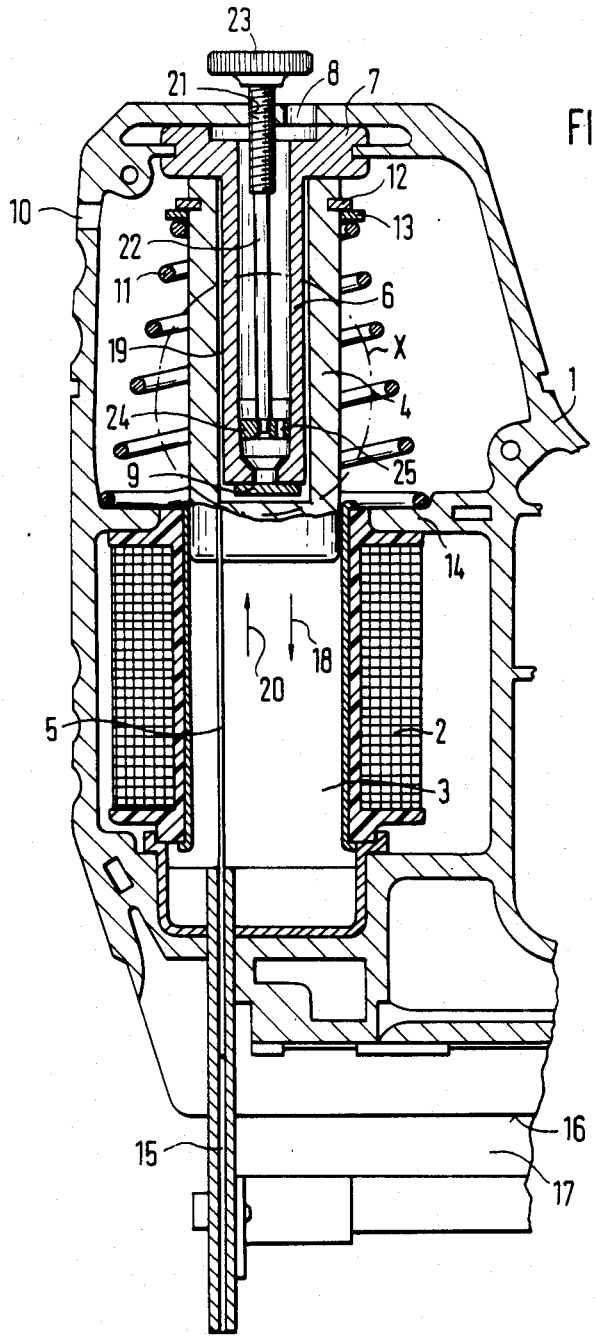
FIG. 1 is an axial sectional view through a driving tool of the first embodiment of the invention.

Referring now to the drawings in detail, the driving tool of the invention has a housing 1 in which a coil or solenoid 2 of the electromagnetic device is arranged. A cup-shaped plunger 4 and a driving blade 5 rigidly connected thereto are movingly guided through a cylindrical interior 3 of the solenoid. The plunger 4 in addition is axially displaceable on or relative to a hollow cylinder 6. An enlarged foot 7 of the hollow cylinder 6 is rigidly fastened to the tool housing 1. A vent opening 8 provided in the housing 1 connects the interior of the hollow cylinder 6 with atmospheric air. At the inner end of the hollow cylinder 6, a valve flap 9 is provided so that air coming from the outside can freely flow through the hollow cylinder and its discharge from that cylinder is in this way prevented. The space about the plunger 4 is vented outwardly, which is provided by means of a vent opening 10 formed in the housing 1.

A conical helical spring 11 is supported at one end thereof against a spring ring 12 secured at the upper end of plunger 4 and also against a washer 13 slidable on the plunger 4. The bearing support for the helical spring 11 is formed by a rib 14 of the housing 1.

The lower end of the driving blade 5 is guided in a guide passage 15. A magazine guide 16 for a fastener magazine 17 is positioned at right angles to the guide passage 15. Thereby a fastener is inserted into the guide passage 15 before the driving blade 5 in the known manner disclosed in U.S. Pat. No. 4,183,453 mentioned above. In the direction of the axis of elongation of the hollow cylinder 6, the housing 1 has a threaded bore 21. The latter receives an adjustment rod 22, more precisely it receives the threaded portion of this rod. The adjustment rod 22 carries at the outer end thereof a handle 23. The inner end of the adjustment rod 22 is connected with a piston 24 so that the piston must closely perform the same axial movements as those of the adjustment rod 22. Piston 24 includes air-passing openings 25 in order not to preclude ventilation of the interior of the hollow cylinder 6. The interior of the hollow cylinder 6 has in the region of the movement of piston 24 a conical portion 26 as clearly shown in FIG. 2.

Upon the application of a voltage impulse to the solenoid 2, plunger 4, due to the occurring magnetic field, is quickly pulled into the inner space 3 of the solenoid as shown by arrow 18. Thereby the driving blade 5 is moved through the guide passage 15, releases a fastener from the fastener magazine 17 and drives the latter to a workpiece positioned against the guide passage 15. During this movement, the plunger 4 and the interior of the hollow cylinder 6 are filled, via opening 8, with the outer air sucked thereinto, whereby this outer air, with the valve flap 9 closed, sets in cylinder 6 and plunger 4. The driving movement would not also prevent the function of an air damper formed by the plunger 4 and hollow cylinder 6. The magnetic field interrupted at the end of the voltage pulse frees the plunger 4 again so that the latter can, under the action of the helical spring 11, move back to its initial position. Thereby the air found in the interior of plunger 4 is slowly pressed through a throttle gap 19 between the plunger 4 and the hollow cylinder 6 because the valve flap 9 which closes the interior of the hollow cylinder 6 does not permit a free escape of the air outwardly. The return-stroke movement in the direction of arrow 20 is therefore damped, and the click of the plunger 4, during its return movement from the abutment surface provided on the foot 7 of the hollow cylinder 6, is prevented. Thus an unobjectionable function of the driving tool is ensured when the action of the air damper is optimally adjusted. This can be attained by means of the handle 23, adjustment rod 22 and piston 24. By the rotation of the handle 23 and thus the adjustment rod 22 the latter will be moved more or less into or away from the interior of the hollow cylinder 6. The piston 24 is moved to and fro in the region of the conical portion 26 of cylinder 6. Upon the movement of the piston 24 into the conical portion 26 the wall of the hollow cylinder 6 will elastically expand and will make the throttle gap 19 narrower. The action of the air damper would be thus enhanced. The adjustment of the air damper can be in this fashion optimized for any operational conditions.

Figure 4:
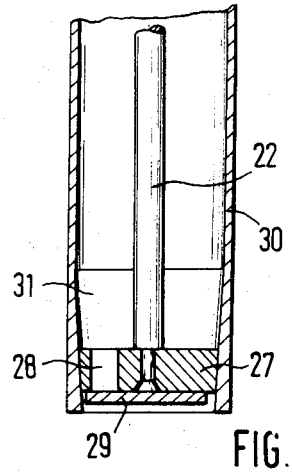
FIG. 4 is a partial sectional view of the second embodiment of the driving tool of the invention.
Figure 5:
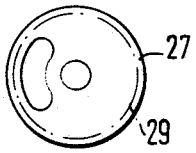
FIG. 5 is a top plan view of the piston of the e mbodiment of FIG. 4.

In the embodiment illustrated in FIGS. 4 and 5 a piston 27 is secured to the adjustment rod 22. Piston 27 has replaced piston 24 and is provided with a single air-passing opening 28. In place of the valve flap 9, at the end of the hollow cylinder 6 is provided a valve flap 29, which is applied directly to the end face of the piston 27. The hollow cylinder utilized in this embodiment has a cone 31 in which piston 27 can move by the ajustment rod 22. The taper of the cone 31, as shown in FIG. 4, is such that the outlet opening of the interior of the hollow cylinder 30 is narrowed. It is understandable that a reverse tapering of cone 31 is also conceivable. The action of the hollow cylinder 30 for the expansion of the outer diameter remains the same. It only changes the direction of the adjustment for the expansion or compression. The embodiment of FIGS. 4 and 5 is technically easier to manufacture.

Figure 2:
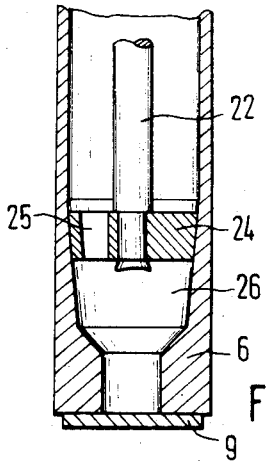
FIG. 2 is an enlarged view "X" of FIG. 1.
Figure 3:
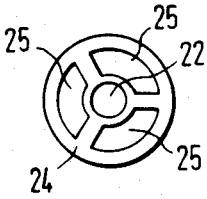
FIG. 3 is a top plan view of the piston of the tool of FIG. 1.
Figure 6:
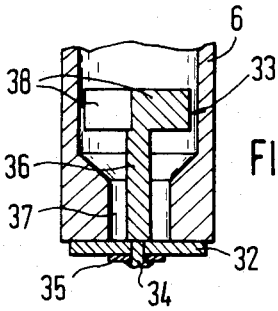
FIG. 6 is a partial sectional view of the check valve.
Figure 7:
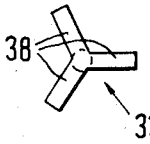
FIG. 7 is a top plan view of the portion of the check valve of FIG. 6, guided in the hollow member.

In the embodiment of FIGS. 6 and 7, a check valve of a modified construction, as compared to that of FIGS. 1–3, is illustrated. In place of the valve flap 9, a valve plate 32 is provided, which is connected to a support member or insert 33. The valve plate 32 is secured to a pin 34 of the support member 33 by means of riveting or melting with the interposition of a washer 35 between the riveted end of pin 34 and the end face of the valve plate 32. An inner collar 36 of the support member 33 engagingly extends through the outlet opening 37 of the hollow cylinder 6 and carries at its inner end three blades 38. The so-formed head of the support member 33 does not prevent the movement of air within the hollow cylinder 6 but precludes dropping of the valve out from the interior of the hollow cylinder 6. The mode of operation of this check valve corresponds to that of the valve flap 9 and can be readily understood from FIG. 6. It is, of course understandable that the movement range of the support member 33 outside the movement range of piston 24 is supported. The conical portion 26 is positioned in this embodiment at a predetermined distance from the support member 33. This structure is advantageous when the end face, in the case of a thinned hollow cylinder, is not sufficient for securing thereto of the valve flap 9.

It will be understood that each of the elements described above, or two or more together, may also find a useful application in other types of electromagneticzlly operated driving tools differing from the types described above.

While the invention has been illustrated and described as embodied in an electromagnetically operated driving tool with an air damper, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An electromagnetically operated driving tool, comprising a solenoid; a cup-shaped plunger axially slidable within said solenoid; a hollow member axially extended in said plunger and forming therewith an air damper; a check valve cooperating with said hollow member; a return spring acting on said plunger, said hollow member and said plunger forming therebetween a throttle gap; a driver blade connected to said plunger to move therewith, wherein a return stroke of said driver blade is affected by said air damper; and a piston received in said hollow member, said piston causing an elastic expansion of said hollow member whereby said throttle gap formed between an outer surface of said hollow member and an inner surface of said plunger is changed.

2. The driving tool as defined in claim 1, wherein said hollow member is a cylinder having an interior formed with a conical portion at a free end thereof, said piston being displaceable in the region of said conical portion.

3. The driving tool as defined in claim 2, wherein said piston has at least one opening for passing air therethrough.

4. The driving tool as defined in claim 3, wherein said piston carries said check valve, said check valve being a valve flap.

5. The driving tool as defined in claim 1, wherein said valve includes an insert axially movable in the interior of said hollow member and a valve flap at an end of said insert.

6. The driving tool as defined in claim 1, further including a housing; an adjustment rod extended in said hollow member, said piston being axially non-movably connected to said rod, said rod having a handle position outside said housing and a threaded portion extended through a threaded bore formed said housing.

7. The driving tool as defined in claim 1, wherein said hollow member is made of an elastic plastic and has a thin wall to provide said elastic expansion.

* * * * *